US008517692B2

(12) United States Patent
Hopwood et al.

(10) Patent No.: US 8,517,692 B2
(45) Date of Patent: Aug. 27, 2013

(54) PRESSURE LIMITING CONTROLLER

(75) Inventors: Fergus Hopwood, Houston, TX (US); Arun Natarajan, Houston, TX (US)

(73) Assignee: Omron Oilfield & Marine, Inc., Houston, TX (US)

( * ) Notice: Subject to any disclaimer, the term of this patent is extended or adjusted under 35 U.S.C. 154(b) by 423 days.

(21) Appl. No.: 12/868,265

(22) Filed: Aug. 25, 2010

(65) Prior Publication Data

US 2012/0048620 A1 Mar. 1, 2012

(51) Int. Cl.
*F04B 49/08* (2006.01)
*E21B 21/08* (2006.01)

(52) U.S. Cl.
USPC ..... 417/44.2; 417/18; 417/20; 417/22; 417/44.1; 175/38; 175/48

(58) Field of Classification Search
USPC ..... 417/18, 20, 22, 42, 43, 44.1, 44.2; 700/275, 282; 175/38, 48
See application file for complete search history.

(56) References Cited

U.S. PATENT DOCUMENTS 3,602,322 A * 8/1971 Gorsuch ..... 175/48
6,718,759 B1 * 4/2004 Tabor ..... 60/368
6,820,702 B2 * 11/2004 Niedermayr et al. ..... 175/57

* cited by examiner

*Primary Examiner* — Charles Freay
*Assistant Examiner* — Philip Stimpert
(74) *Attorney, Agent, or Firm* — Osha Liang LLP

(57) ABSTRACT

A method of controlling pressure in a mud pump system includes generating a pressure limiting factor output using a pressure feedback input and a motor speed input to calculate a fluid conductance estimate, maintaining the pressure limiting factor output at a maximum value based on a pressure set-point, continuously updating a normal fluid conductance value based on the fluid conductance estimate while the pressure limiting factor output remains at the maximum value, freezing the normal fluid conductance value, if the pressure limiting factor output is less than the maximum value, calculating a change in fluid conductance based on the normal fluid conductance value and the fluid conductance estimate, generating at least one adaptive gain based on the change in fluid conductance, and controlling a motor speed of a pump in the mud pump system based on the at least one adaptive gain.

18 Claims, 7 Drawing Sheets

(a) Time histories of motor speed and stand-pipe pressure for 30% blockage.

(b) Time histories of motor speed and stand-pipe pressure for 50% blockage.

(a) Time histories of motor speed and stand-pipe pressure for 10% blockage.

(b) Time histories of motor speed and stand-pipe pressure for 30% blockage.

(c) Time histories of motor speed and stand-pipe pressure for 50% blockage.

PRESSURE LIMITING CONTROLLER

BACKGROUND OF INVENTION

1. Field of the Invention

Embodiments disclosed herein relate generally to apparatus and methods for controlling drilling fluid or "mud" pressure in a mud pump system. More specifically, embodiments disclosed herein relate to using a pressure limiting controller for controlling mud pressure.

2. Background Art

During a drilling operation, drilling fluid or "mud" is circulated through a mud pump system. Typically, mud flows down a drillstring to a rotating drill bit, which is suspended in a borehole. The mud flows through the drill bit by exiting through openings in the drill bit. As the mud exits, it flushes out drill cuttings generated by the drill bit. Then, the mud flows up an annular space between the drillstring and the sides of the borehole, carrying the drill cuttings to the surface.

Under normal operating conditions of the mud pump system, the factors affecting the hydraulic characteristics of the mud are fairly constant at a given depth. Depending on the working pressure requirement, the pumping rate of the mud pump is determined, and the mud pump is maintained at this constant rate. However, these hydraulic characteristics can suddenly change due to blockages in the drill bit. If the pumping rate is maintained the same as before, these blockages can cause a sudden surge in mud pressure.

Safety valves are currently used to relieve the system if the pressure surge exceeds the maximum allowable pressure. However, these safety valves present a limitation because when they open in response to a sudden pressure surge, the mud flow diverts back to the surface tanks, shutting down the drilling operation. Frequent shutdowns are undesirable. Furthermore, conventional pressure control systems are generally unstable and cannot accommodate various levels of blockage and operating conditions.

SUMMARY OF INVENTION

In general, in one aspect, embodiments disclosed herein relate to a mud pump system comprising: a pump adapted to pump a pressurized flow of mud from a mud container through a drillstring in a borehole; pressure sensors disposed in contact with the pressurized flow for detecting a pressure of the pressurized flow; a pressure limiting controller configured to control a motor speed of the pump in response to the pressure detected by the pressure sensors, wherein the pressure limiting controller generates a pressure limiting factor output using a pressure feedback input and a motor speed input to calculate a fluid conductance estimate, wherein the pressure limiting controller maintains the pressure limiting factor output at a maximum value based on a pressure set-point, wherein the pressure limiting controller continuously updates a normal fluid conductance value based on the fluid conductance estimate while the pressure limiting factor output remains at the maximum value, wherein the pressure limiting controller freezes the normal fluid conductance value, if the pressure limiting factor output is less than the maximum value, wherein the pressure limiting controller calculates a change in fluid conductance based on the normal fluid conductance value and the fluid conductance estimate, wherein the pressure limiting controller generates at least one adaptive gain based on the change in fluid conductance, and wherein the pressure limiting controller controls a motor speed of a pump in the mud pump system based on the at least one adaptive gain.

In general, in one aspect, embodiments disclosed herein relate to a method of controlling pressure in a mud pump system comprising: generating a pressure limiting factor output using a pressure feedback input and a motor speed input to calculate a fluid conductance estimate, maintaining the pressure limiting factor output at a maximum value based on a pressure set-point, continuously updating a normal fluid conductance value based on the fluid conductance estimate while the pressure limiting factor output remains at the maximum value, freezing the normal fluid conductance value, if the pressure limiting factor output is less than the maximum value, calculating a change in fluid conductance based on the normal fluid conductance value and the fluid conductance estimate, generating at least one adaptive gain based on the change in fluid conductance, and controlling a motor speed of a pump in the mud pump system based on the at least one adaptive gain.

In general, in one aspect, embodiments disclosed herein relate to a method of controlling pressure in a mud pump system comprising: generating a pressure limiting factor output using a pressure feedback input and a motor speed input to calculate a fluid conductance estimate, maintaining the pressure limiting factor output at a maximum value based on a pressure set-point, continuously updating a normal fluid conductance value based on the fluid conductance estimate while the pressure limiting factor output remains at the maximum value, freezing the normal fluid conductance value, if the pressure limiting factor output is less than the maximum value, calculating a change in fluid conductance based on the normal fluid conductance value and the fluid conductance estimate, generating at least one adaptive gain based on the change in fluid conductance, and controlling a motor speed of a pump in the mud pump system based on the at least one adaptive gain.

Other aspects and advantages of the invention will be apparent from the following description and the appended claims.

DETAILED DESCRIPTION

Embodiments of the present invention will be described below with reference to the figures. In one aspect, embodiments disclosed herein relate to apparatus and methods for controlling drilling fluid or "mud" pressure in a mud pump system. More specifically, embodiments disclosed herein relate to using a pressure limiting controller to control mud pressure in a drilling rig.

Figure 1:
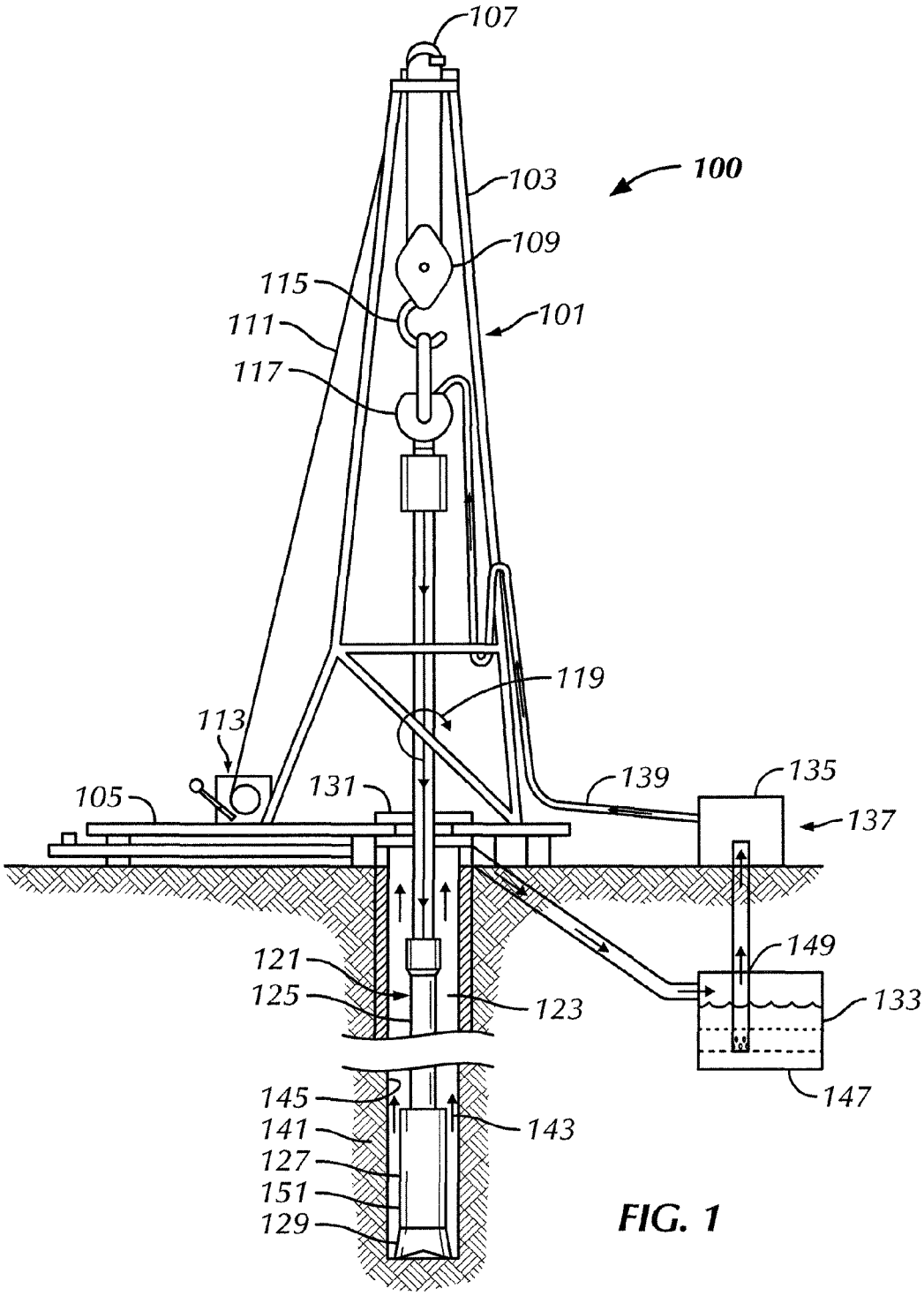
FIG. 1 is a schematic view drawing of a drilling rig to drill a borehole.

Referring initially to FIG. 1, a rotary drilling system 100 including a drilling rig 101 is shown. While drilling rig 101 is depicted in FIG. 1 as a land-based rig, it should be understood by one of ordinary skill in the art that embodiments of the present disclosure may apply to any drilling system including, but not limited to, offshore drilling rigs such as jack-up rigs, semi-submersible rigs, drill ships, and the like. Additionally, although drilling rig 101 is shown as a conventional rotary rig, wherein drillstring rotation is performed by a rotary table, those skilled in the art in possession of the present disclosure will readily appreciate that embodiments may be applicable to other drilling technologies including, but not limited to, top drives, power swivels, downhole motors, coiled tubing units, and the like.

As shown, drilling rig 101 includes a mast 103 supported on a rig floor 105 and lifting gear comprising a crown block 107 and a traveling block 109. Crown block 107 may be mounted on mast 103 and coupled to traveling block 109 by a cable 111 driven by a draw works 113. Draw works 113 controls the upward and downward movement of traveling block 109 with respect to crown block 107, wherein traveling block 109 includes a hook 115 and a swivel 117 suspended therefrom. Swivel 117 may support a Kelly 119, which, in turn, supports drillstring 121 suspended in borehole 123.

Typically, drillstring 121 is constructed from a plurality of threadably interconnected sections of drill pipe 125 and includes a bottom hole assembly ("BHA") 127 at its distal end. BHA 127 may include stabilizers, weighted drill collars, formation measurement devices, downhole drilling motors, and a drill bit 129 connected at its distal end. Those skilled in the art in possession of the present disclosure will readily appreciate that the specific configuration and components of BHA 127 employed may change depending on the environment and operations involved.

During drilling operations, drillstring 121 may be rotated in borehole 123 by a rotary system 131 that is rotatably supported on rig floor 105 and engages Kelly 119 through a Kelly bushing. Alternatively, a top drive assembly (not shown) may directly rotate and longitudinally displace drillstring 121 absent Kelly 119. The torque applied to drillstring 121 by drilling rig 101 to rotate drillstring 121 is often referred to as rotary torque or drilling torque.

Drilling fluid, often referred to as drilling "mud," 133 is delivered to drill bit 129 through a bore of drillstring 121 by at least one mud pump 135 of a mud pump system 137 through a mud hose 139 connected to swivel 117. In order to drill through a formation 141, rotary torque and axial force may be applied to drill bit 129 to cause cutting elements disposed on drill bit 129 to cut into and break up formation 141 as drill bit 129 is rotated. Cuttings produced by drill bit 129 are carried out of borehole 123 to the surface through an annulus 143 formed between drillstring 121 and borehole wall 145 by mud 133 pumped through drillstring 121. Cuttings are removed from mud 133 with equipment not shown, and mud 133 is re-circulated from a mud container 147 by at least one mud pump 135 of mud pump system 137 back to drillstring 121. To clarify, mud 133 is circulated through rotary drilling system 100 via a mud flow 149 from mud container 147, through mud pump system 137, through mud hose 139, through drillstring 121, through drill bit 129, up annulus 143, and back to mud container 147. This mud flow 149 is depicted in FIG. 1 with arrows.

As shown, a pressure sensor 151 may be provided in BHA 127 located above drill bit 129. Pressure sensor 151 may be operatively coupled to a measurement-while-drilling system (not shown) in BHA 127. Additional pressure sensors may be located throughout drillstring 121. Pressure sensor 151 may be used to measure the pressure of mud 133 as the mud flows through drillstring 121. Pressure measurements made by pressure sensor 151 may be communicated to equipment at the surface, including mud pump system 137.

Figure 2:
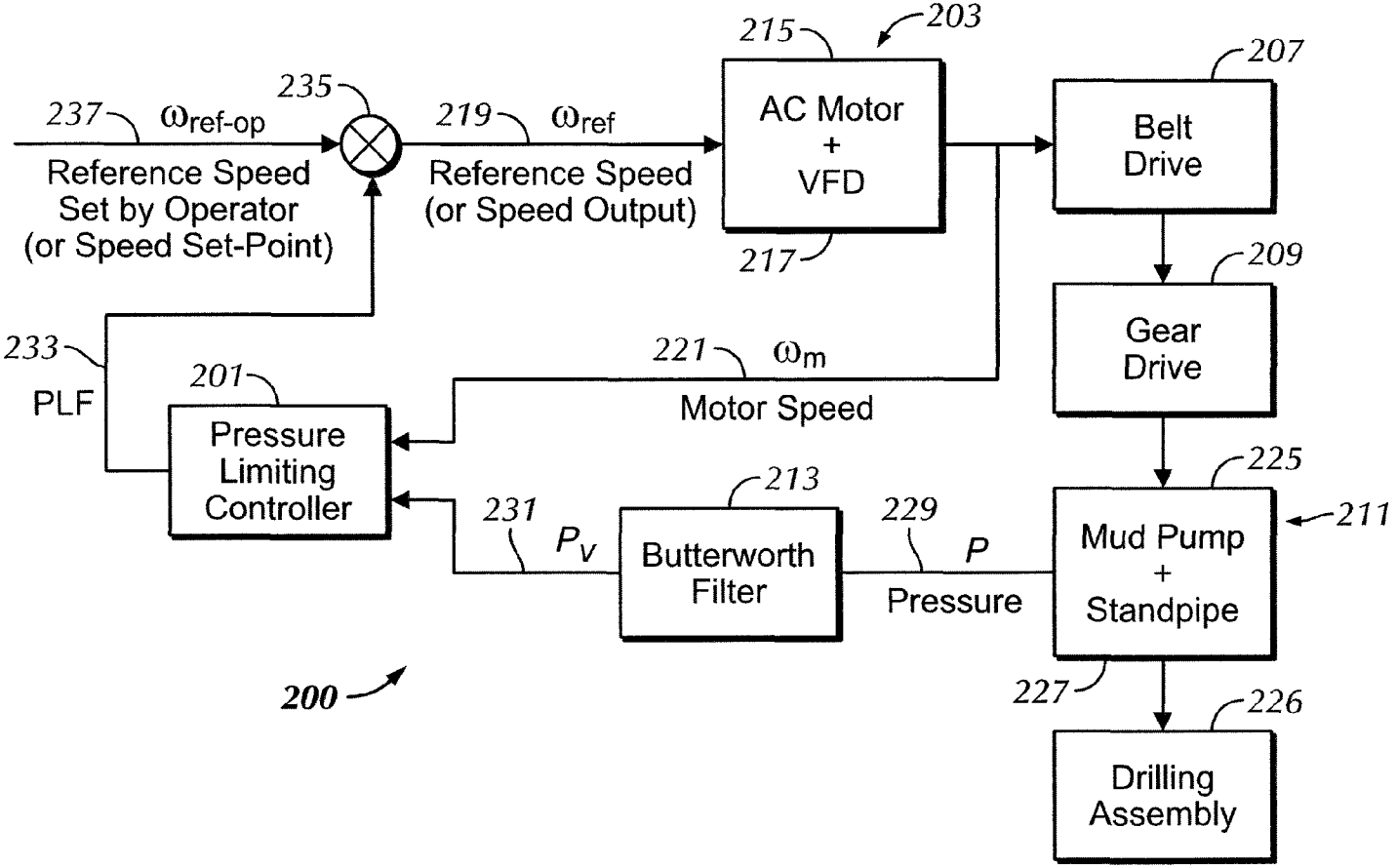
FIG. 2 is a schematic block diagram of a mud pump system with a pressure limiting controller.

Referring now to FIG. 2, a mud pump system 200 with a pressure limiting controller 201 in accordance with one or more embodiments is shown schematically. Mud pump system 200 includes an AC drive 203, an encoder 205, a belt drive 207, a gear drive 209, a mud pump and hydraulic model 211, a Butterworth filter 213, and pressure limiting controller 201. Mud pump system 200 is used to deliver a large volume of mud flowing under pressure during drilling operations.

As shown, mud pump system 200 is driven by AC drive 203, the electrical component of mud pump system 200. AC drive 203 is comprised of an AC motor 215 and a variable frequency drive (VFD) 217. VFD 217 regulates the speed of AC motor 215. AC drive 203, which comes with regenerative braking, accurately tracks a reference speed ($\omega_{ref}$) or speed output 219 of mud pump system 200. AC motor 215 supplies a motor speed ($\omega_m$) 221 to pressure limiting controller 201.

As further shown, AC drive 203 supplies power to the mechanical components of mud pump system 200—belt drive 207, gear drive 209, mud pump 225 of mud pump+ drilling standpipe 211, and drilling assembly 226. Indeed, mud pump 225 is connected to AC drive 203 through belt drive 207 and gear drive 209, which are transmission drives. Belt drive 207 is used to transmit speed, torque, and inertia from AC drive 203 to gear drive 209. Gear drive 209 is used to transmit speed, torque, and inertia from belt drive 207 to mud pump 225.

In accordance with one or more embodiments, mud pump system 200 includes at least one mud pump 225. Indeed, mud pump system 200 may have multiple mud pumps. Additionally, mud pump 225 may be a triplex mud pump, duplex mud pump, hex mud pump, or the like.

As can be seen, a drilling standpipe 227 of mud pump+ drilling standpipe 211 is included. Drilling standpipe 227 constitutes the actual drilling fluid or mud circulating through mud pump system 200. Mud circulating through mud pump system 200 is flowing under pressure. As mentioned during the description of FIG. 1, a pressure sensor may be used to generate a measured pressure (P) 229 of the mud flowing through mud pump system 200. This measured pressure 229 is noisy and is filtered using a Butterworth filter 213. Butterworth filter 213 generates a pressure feedback input ($P_v$) 231 that is used by pressure limiting controller 201.

In accordance with one or more embodiments, pressure limiting controller 201 uses motor speed input 223 and pressure feedback input 231 to generate a pressure limiting factor output (PLF) 233. A multiplier 235 multiplies PLF 233 by a reference speed set by operator or speed set-point ($\omega_{ref\text{-}op}$) 237 to generate speed output 219.

When measured pressure 229 of mud pump system 200 surges because of a blockage in the drill bit, pressure limiting controller 201 can reduce motor speed 221 by a factor (PLF 233), which will allow measured pressure 229 to decrease back down to a safe operating level. This, along with the role pressure limiting controller 201 plays in mud pump system 200 is discussed in further detail below.

Figure 3:
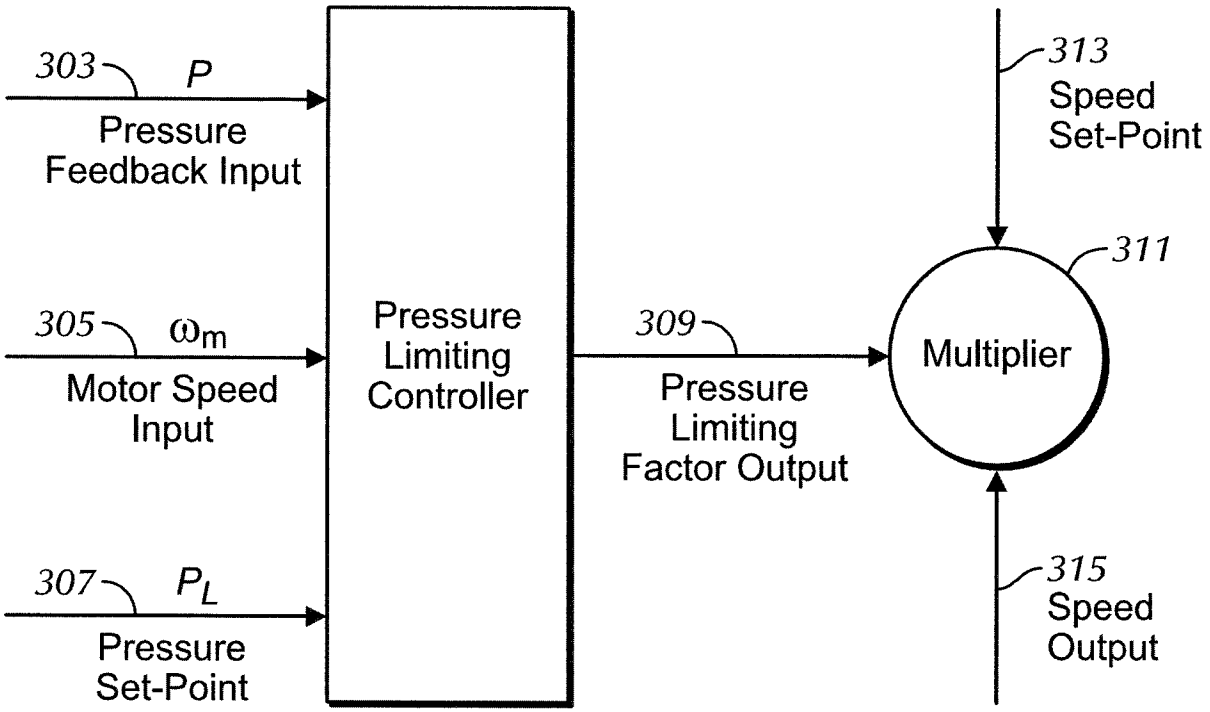
FIG. 3 is a simplified block diagram of a mud pump system with a pressure limiting controller.

Referring now to FIG. 3, a simplified depiction of a mud pump system 300 with a pressure limiting controller 301 in accordance with one or more embodiments of the present disclosure is shown schematically. As shown, inputs of pressure limiting controller 301 include pressure feedback input (P) 303, motor speed input ($\omega_m$) 305, and pressure set-point (PL) 307.

As previously discussed, pressure feedback input 303 is filtered and less noisy than the measured pressure generated by a pressure sensor. Indeed, pressure feedback input 303 represents the pressure of the mud flowing through mud pump system 300. As also discussed, motor speed input 305 is the feedback generated by the encoder using the motor speed of mud pump system 300. Pressure feedback input 303 and motor speed input 305 may be used to estimate a fluid conductance of mud pump system 300 by the formula $K_2est=\omega_m/\sqrt{P}$.

This is important because fluid conductance is indicative of mud flow through the drill bit of mud pump system 300. When fluid conductance is high, mud easily flows through the drill bit of mud pump system 300. Fluid conductance may be reduced, however, if there is a blockage in the drill bit. Because fluid conductance is inversely proportional to pressure feedback input 303, reduced fluid conductance will cause a sudden surge in pressure feedback input 303. To counter this sudden pressure surge, pressure limiting controller 301 is configured to generate a pressure limiting factor output (PLF) 309. As discussed further below, PLF 309 can reduce the motor speed of mud pump system 300, which will allow pressure feedback input 303 to decrease back down to a safe operating level.

Another input of pressure limiting controller is pressure set-point 307. Pressure set-point 307 is a pressure limit set by an operator of mud pump system 300. Operator may be an actual person, program, computer, or the like. The normal working pressure of mud pump system 300 (without any blockage) is less than pressure set-point 307. As shown, pressure limiting controller 301 uses pressure set-point 307 to generate PLF 309.

As shown, a multiplier 311 is a component of mud pump system 300. Inputs to multiplier 311 are PLF 309 generated by pressure limiting controller 301 and speed set-point 313. Speed set-point 313 is a reference speed set by an operator of mud pump system 300. Operator may be an actual person, program, computer, or the like. Multiplier 311 multiplies PLF 309 and speed set-point 313 to generate a speed output 315. Speed output 315 is transferred to the AC drive of mud pump system 300 and is used to determine the speed of mud pump system 300. Because motor speed is related to mud pressure, as discussed in more detail below, speed output 315 may be used to control the mud pressure of mud pump system 300.

Figure 4:
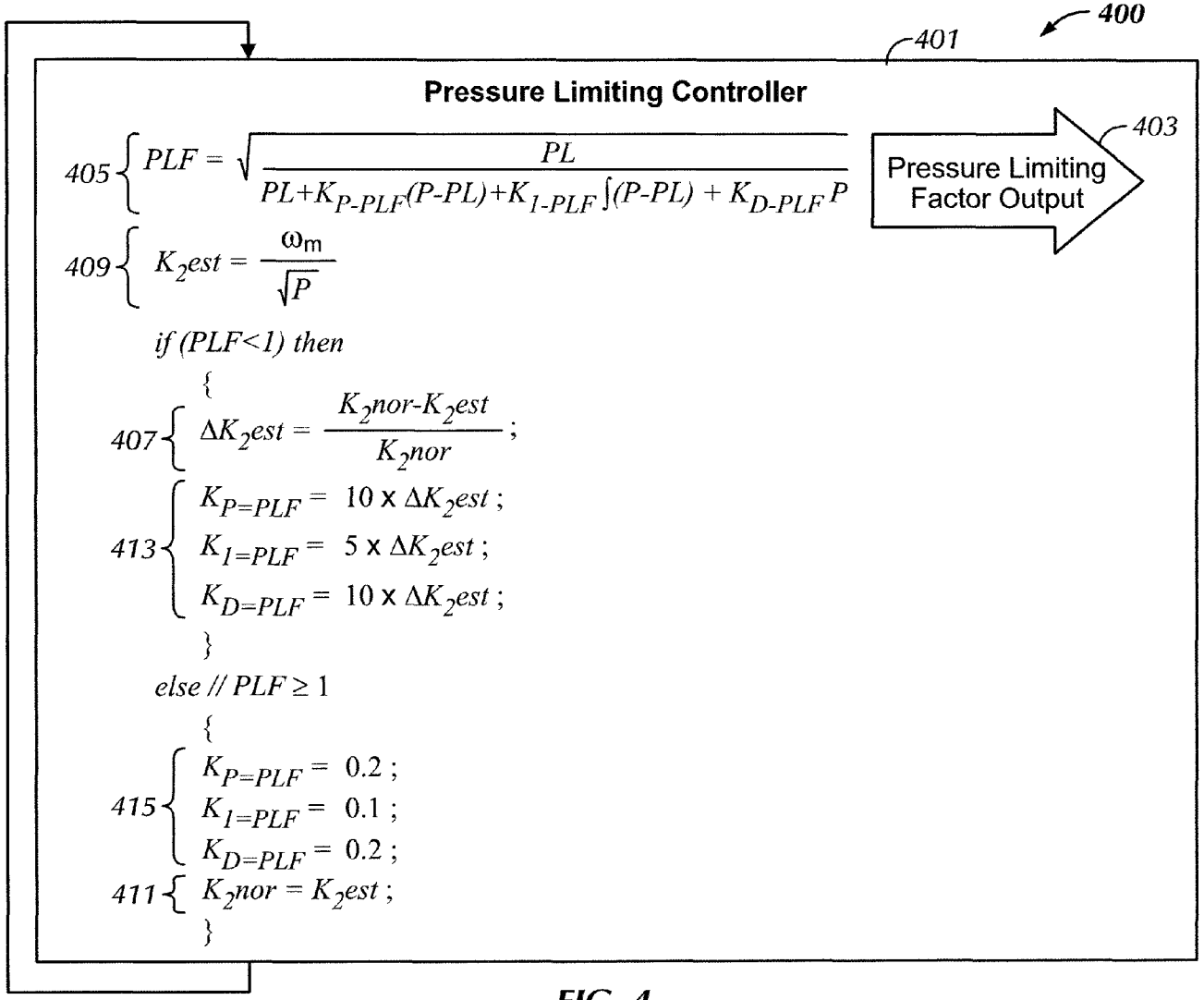
FIG. 4 is a blown-up partial view of the schematic block diagram of FIG. 3 to show the internal processes of the pressure limiting controller.

Referring now to FIG. 4, a blown-up view of the internal processes of a pressure limiting controller 401 of a mud pump system 400 in accordance with one or more embodiments is shown schematically. As shown, pressure limiting controller 401 is configured to generate a pressure limiting factor output (PLF) 403. As previously discussed, PLF 403 is multiplied by a speed set-point to generate a speed output, which may be used to control the mud pressure of mud pump system 400.

Indeed, there is a relationship between the motor speed and the mud pressure of mud pump system 400. First, the mud flow rate (pumping rate of the mud pump, $Q_p$), mud pressure (P), and fluid conductance ($K_2$) of mud pump system 400 are related by the formula $$P=\left(\frac{2Q_p}{K_2}\right)^2.$$

Because the mud flow rate $Q_p$ is proportional to the motor speed ($\omega_m$) of mud pump system 400, the following equation of proportionality results:

$$P\propto\left(\frac{\omega_m}{K_2}\right)^2.$$

As such, pressure is directly proportional to the square of motor speed and inversely proportional to the square of fluid conductance.

A block in the drill bit will result in a change (decrease) in the fluid conductance. Further, if the motor speed is maintained constant, then, there will be an increase in pressure. Accordingly, if the new reduced fluid conductance value is set to be $K'^2$ and the new pressure is set to be P', the equation of proportionality in the event of a drill bit blockage is $$P'\propto\left(\frac{\omega_m}{K_2'}\right)^2.$$

Alternately, by changing the motor speed, the pressure can be maintained constant. That is, motor speed $\omega_m$ can be reduced by a factor $\xi$ such that the fluid pressure returns back to P, with modified fluid conductance $K'_2$. Accordingly, the equation of proportionality when the motor speed is reduced by a factor in response to a drill bit blockage is $$P\propto\left(\frac{\xi\omega_m}{K_2'}\right)^2.$$

With respect to the previous two equations of proportionality, the following equation of proportionality may result: $P\propto(\xi)^2P'$. Rearranging this equation of proportionality gives $$\xi\propto\sqrt{\frac{P}{P'}}.$$

Rewriting this proportionality expression in terms of change in pressure $\Delta P(\Delta P=P'-P)$ gives $$\xi\propto\sqrt{\frac{P}{P+\Delta P}}.$$

This final equation of proportionality provides a basis for how the motor speed should be reduced to counter an increase in mud pressure. Based on this, pressure limiting controller 401 is developed. Indeed, a PLF equation 405 shown in FIG. 4 is adapted from this equation of proportionality. For the sake of convenience, PLF equation 405 is reproduced here so that PLF equation 405 and the final equation of proportionality may be more easily compared:

$$PLF=\sqrt{\frac{PL}{PL+K_{P-PLF}(P-PL)+K_{I-PLF}\int(P-PL)+K_{D-PLF}\dot{P}}}$$

In the above PLF equation 405 as compared to the final equation of proportionality, PLF 403 is the factor $\xi$, pressure set-point (or pressure limit) PL is the pressure P, and the proportional, derivative, and integral gains represent the change in pressure $\Delta P$.

Referring back to FIG. 4, pressure limiting controller 401 is continuously ON. The normal working pressure of mud pump system 400 (without any blockage) is less than the pressure set-point (or pressure limit) set by an operator. Because the pressure limiting controller 401 tries to maintain the pressure at the pressure limit, an increase in the reference speed can result (i.e., PLF 403 will be greater than unity). In order to prevent mud pump system 400 from exceeding the original reference speed, a limit (or maximum value) is placed on pressure limiting factor 403. In one or more embodiments, the maximum value allowed for pressure limiting factor 403 is unity. However, in one or more embodiments, the pressure limiting factor 403 may be set to any numeric maximum value.

Notably, the gains of PLF equation 405 are not constant and are set to vary with the operating condition of mud pump system 400. Under normal operating conditions, the gain values may be set very low. For example, in one or more embodiments, proportional gain may be set to 0.2, integral gain may be set to 0.1, and derivative gain may be set to 0.2. In the event of a blockage in the drill bit, the gain values are increased proportional to the level of blockage.

Numeric analysis carried out using this control showed that there was no universal value for the gains, $K_{P\text{-}PLF}$, $K_{I\text{-}PLF}$, and $K_{D\text{-}PLF}$, that stabilized all possible degrees of blockage in the drill bit, even though one could identify gains for a particular degree of blockage. For example, the gain settings for a blockage that would require the flow rate to be reduced to 30% of the original flow rate would not work for another blockage that would require the flow rate to be reduced to 70%. This is the reason for varying the gains continuously depending on the level of blockage.

It is not possible to measure the degree of blockage as such, but a change in fluid conductance ($\Delta K_2$est) 407 of the drill bit is indicative of the level of blockage. As previously discussed, it is possible to estimate fluid conductance based on measurable quantities such as the pressure and flow rate. Because flow rate is proportional to motor speed (as previously discussed), a fluid conductance estimate ($K_2$est) 409 may be calculated using the equation: $K_2\text{est}=\omega_m/\sqrt{P}$. Indeed, the variables used to compute $K_2$est 409 are the motor speed input 305 and the pressure feedback input 303 mentioned during the discussion of FIG. 3. As such, pressure limiting controller 401 may readily use motor speed input 305 and pressure feedback input 303 to calculate $K_2$est 409.

In order to find change in fluid conductance 407, a value of fluid conductance during normal operating condition ($K_2$nor) 411 is needed. As shown in FIG. 4, $K_2$nor 411 is continuously updated using $K_2$est 409. However, once PLF 403 falls below unity, then $K_2$nor 411 is frozen. Note, it is the derivative part (not shown) of pressure limiting controller 401 that initially drives PLF 403 below unity where there is a sudden increase in pressure. Change in fluid conductance 407 is normalized using $K_2$nor 411 and is given as $$\Delta K_2 est = \frac{K_2 nor - K_2 est}{K_2 nor}.$$

Adaptive gains 413 based on $\Delta K_2$est 407 are given by $K_{P=PLF}=10\times\Delta K_2\text{est}$, $K_{I\text{-}PLF}=5\times\Delta K_2\text{est}$, and $K_{D=PLF}=10\times\Delta K_2\text{est}$ when PLF 403 is less than one, i.e., when a blockage in the drill bit occurs. Normal gains 415 are set by an operator of mud pump system 400. An operator may be an actual person, program, computer, or the like. Normal gains 415 apply under normal operating conditions of mud pump system 400 when PLF 403 is greater than or equal to one, i.e., where there is no blockage in the drill bit.

With respect to the internal processes of pressure limiting controller 401 shown in FIG. 4, $K_2$est 409 is determined according to the equation $K_2\text{est}=\omega_m/\sqrt{P}$. As previously discussed, all of the variables of this equation are measurable quantities of mud pump system 400.

In addition, PLF 403 is determined according to PLF equation 405. As previously discussed, all of the variables contained in PLF equation 405 are either measurable quantities of mud pump system 400 or are set by an operator. Normal gains 415 may be plugged into PLF equation to obtain an initial PLF 403. For the sake of clarity, the (P−PL), $\int$(P−PL), and $\dot{P}$ products of PLF equation 405 are the error in pressure (e), the integral of the error ($e_i$), and the derivative of the error ($e_d$), respectively, where $$e_d = \frac{d}{dt}(e) = \frac{e(t_1) - e(t_0)}{t_1 - t_0},$$

and where $t_1$ and $t_0$ are set times. The integral of error is frozen when PLF 403 is equal to one, and there is no negative value for the derivative of error. Even so, the aforementioned products (or errors) of PLF equation 405 may be calculated using pressure (P), a measurable quantity, pressure set-point (PL), a quantity set by an operator.

Under normal operating conditions, PLF 403 will be greater than or equal to one. Note, that PLF 403 may be normalized such that if PLF 403 is greater than one, PLF 403 may be set to equal one. When PLF 403 is greater than or equal to one, normal gains 415 are plugged back into PLF equation 405, and $K_2$nor 411 is updated with $K_2$est 409. The internal processes of pressure limiting controller 401 iterate continuously until PLF 403 is less than one. PLF 403 will become less than one if mud pressure exceeds the pressure limit as a result of a blockage in the drill bit. When that occurs, $K_2$nor 411 is not updated with the most recent $K_2$est 409. Instead, $K_2$nor 411 is frozen and is used to calculate $\Delta K_2$est 407 in accordance with FIG. 4. Then, $\Delta K_2$est 407 is used to generate adaptive gains 413. Because adaptive gains 413 are based on $\Delta K_2$est 407, adaptive gains 413 are proportional to the degree of blockage in the drill bit. Adaptive gains 413 are plugged into PLF equation 405 to generate PLF 403. Because PLF 403 is less than one due to the blockage, when PLF 403 is multiplied by speed set-point 313 as previously mentioned during the discussion of FIG. 3, speed output 315 is reduced. This reduced speed output 315 is transmitted to the VFD of mud pump system 400 to slow down the AC motor. As mentioned before, because pressure is directly proportional to the square of motor speed, the reduction in motor speed allows the mud pressure of mud pump system 400 to decrease back down to a safe operating level.

Based on numerical analysis, some constraints have been introduced in the derivative and integral feedback (not shown) of pressure limiting controller 401. These constraints help pressure limiting controller 401 overcome some operational difficulties and perform better. The constraints are discussed in detail below.

As mentioned previously, pressure limiting controller 401 is constantly ON even where there is no blockage and resultant pressure increase. The normal operating pressure of the system is less than the pressure-limit and pressure limiting controller 401 will force the motor of mud pump system 400 to increase its speed to stabilize the pressure at the higher pressure-limit value. In order to avoid this, a limit is placed on PLF 403 and the value is not allowed to go over unity. This limit ensures that mud pump system 400 remains at normal operating pressure when there is no blockage. However, windup of the integral feedback may occur when PLF 403 is held at unity. Hence, once PLF 403 reaches unity, the integral error is frozen to avoid any windup.

One reason for introducing the derivative feedback is to allow the controller to react quickly to sudden blockage and resulting increase in pressure. The derivative controller (not shown) initially pushes PLF 403 below unity, and triggers the freezing of $K_2$nor 411. Pressure limiting controller 401 has to start reducing the reference speed of the motor as soon as possible to reduce the overshoots in pressure. The derivative feedback helps in achieving this goal. Note that the proportional and integral feedback start reducing the speed only after the pressure exceeds the pressure-limit. When the blockage gets removed, there will be a sudden drop in pressure and pressure limiting controller 401 will restore the speed of the motor. If speed restoration is not critical, the derivative feedback is not used. This can be implemented by allowing only positive values for the time derivative of pressure ($\dot{P}$) and setting the negative values to zero.

Figure 5:
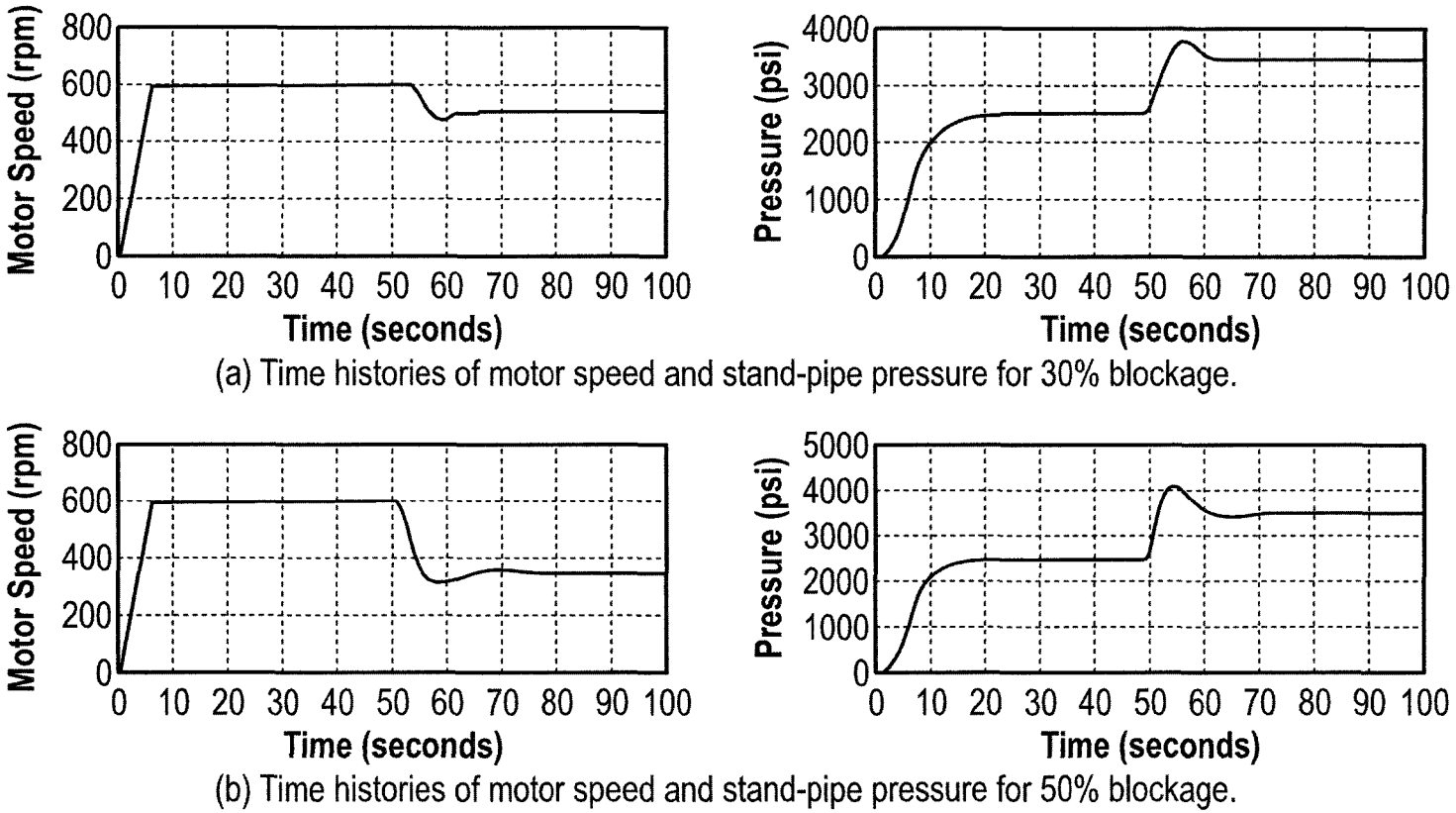
FIG. 5 is a graphical representation of the response of a pressure limiting controller for various levels of blockage when the motor is running at a speed of 600 rpm, the standpipe pressure is 2500 psi, and the pressure limit is 3500 psi.
Figure 6:
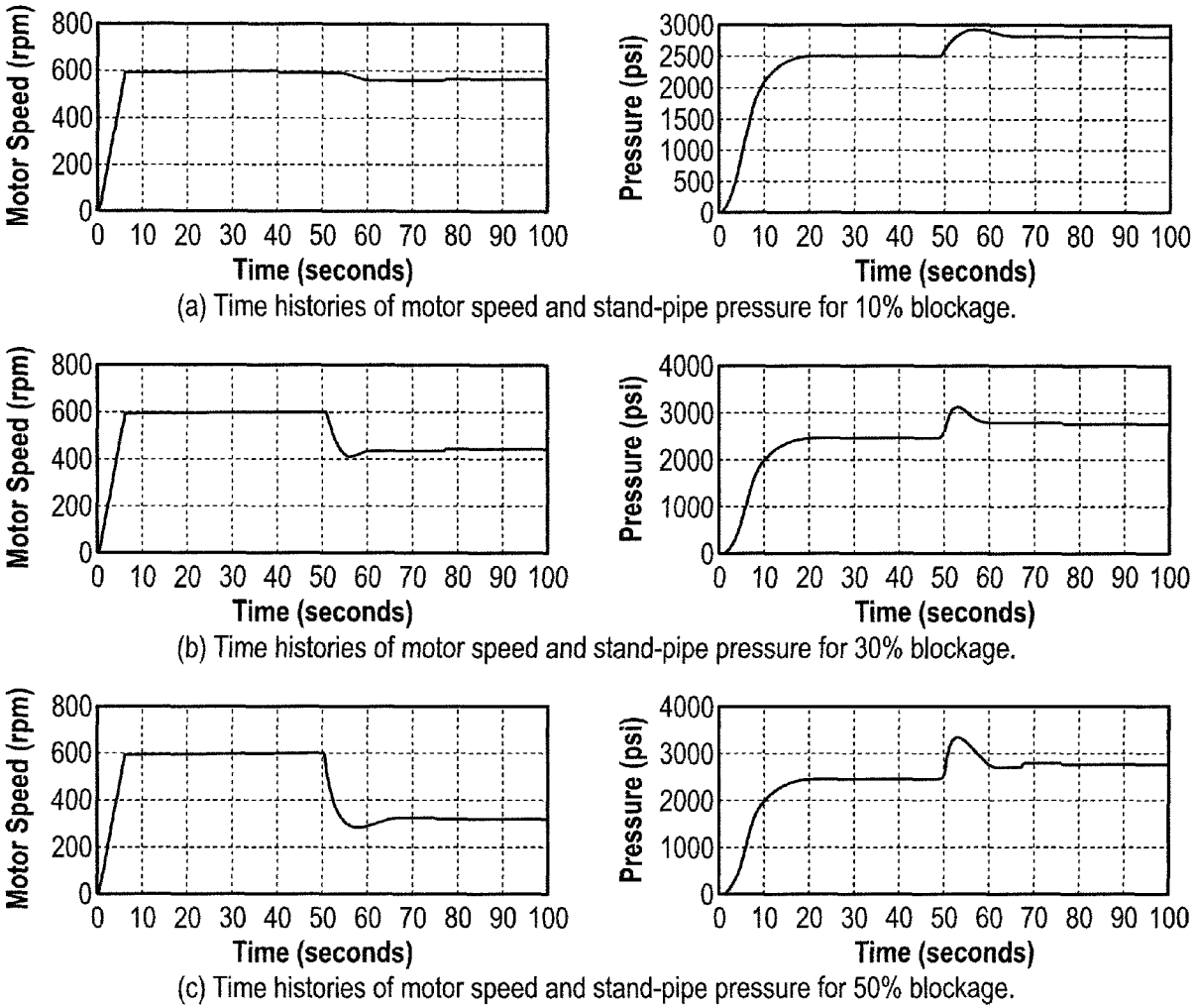
FIG. 6 is a graphical representation of the response of a pressure limiting controller for various levels of blockage when the motor is running at a speed of 600 rpm, the standpipe pressure is 2500 psi, and the pressure limit is 2800 psi.

Referring now to FIG. 5 and FIG. 6, graphical representations of the response of a pressure limiting controller for various levels of blockage in accordance with one or more embodiments are shown.

The graphs show the results from a numerical simulation carried out using a mud pump system model to validate the pressure limiting controller in accordance with one or more embodiments. FIG. 5 shows the response of the pressure limiting controller for two levels of blockage in the mud pump system running at 600 rpm (motor speed), with stand-pipe pressure of 2500 psi and the pressure limit set at 3500 psi. As shown, the mud pump system is stable under both levels of blockage and the motor speed is reduced quickly to keep the stand-pipe pressure at the pressure limit.

FIG. 6 shows the response of the pressure limiting controller for three levels of blockage in the mud pump system running at 600 rpm (motor speed), with stand-pipe pressure of 2500 psi and the pressure limit set at 2800 psi. As shown, the mud pump system is stable under each level of blockage and the motor speed is reduced quickly to keep the stand-pipe pressure at the pressure limit.

Figure 7:
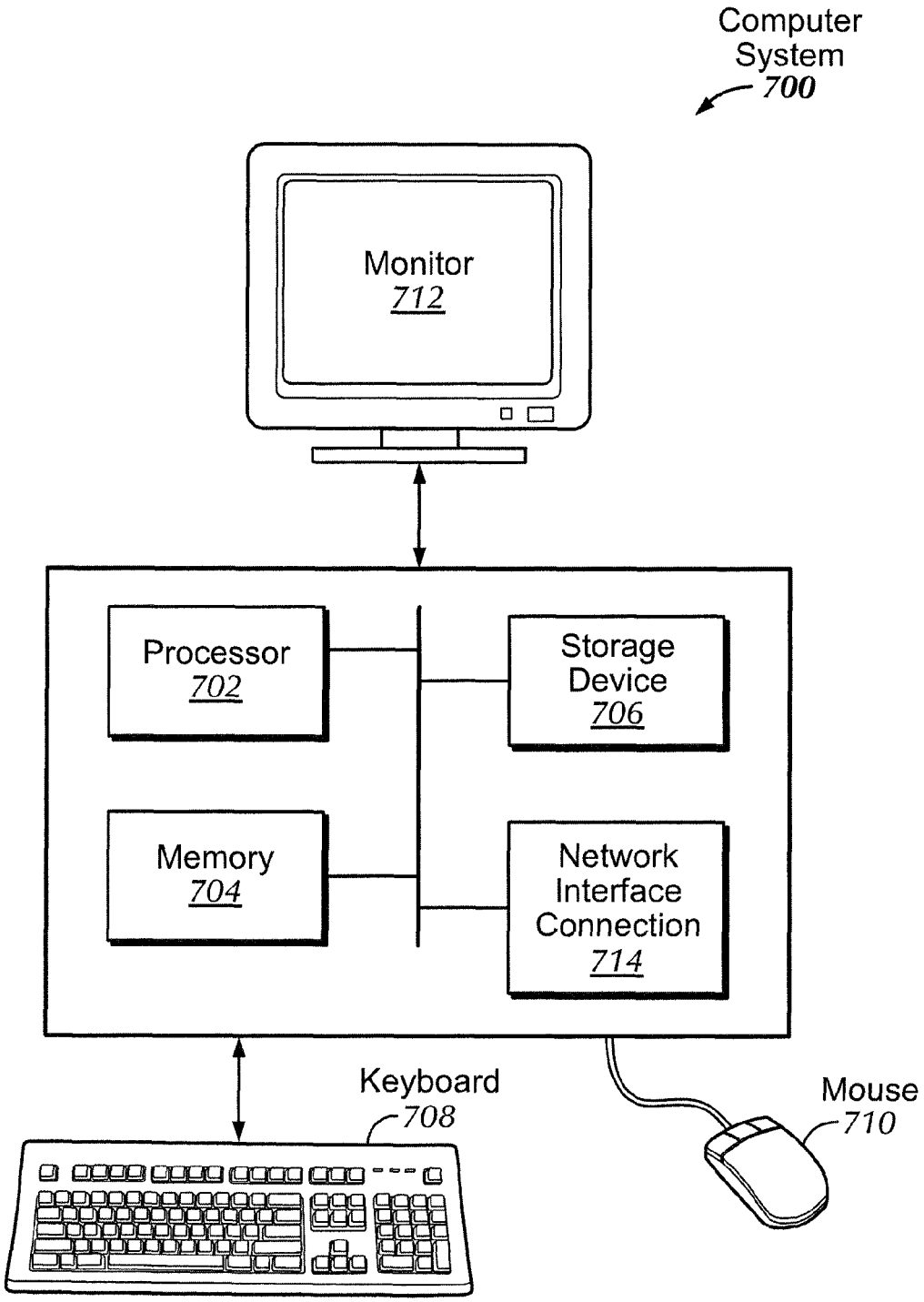
FIG. 7 is a block diagram of computer system.

One or more embodiments of the present invention may be implemented on any type of computer system. For example, as shown in FIG. 7, a computer system 700 includes a processor 702, associated memory 704, a storage device 706, and numerous other elements and functionalities typical of today's computers (not shown). The memory 704 may include instructions executable by the processor 702 for causing the system 700 to control pressure in a mud pump system in accordance with one or more embodiments as described above.

The computer system 700 may also include input means, such as a keyboard 708 and a mouse 710, and output means, such as a monitor 712. The computer system 700 is connected to a local area network (LAN) or a wide area network (e.g., the Internet) (not shown) via a network interface connection 714. Those skilled in the art will appreciate that these input and output means may take other forms, now known or later developed.

Further, those skilled in the art will appreciate that one or more elements of the aforementioned computer system 700 may be located at a remote location and connected to the other elements over a network. Further, one or more embodiments may be implemented on a distributed system having a plurality of nodes, where one or more elements may be located on a different node within the distributed system. In one or more embodiments, the node corresponds to a computer system. Alternatively, the node may correspond to a processor with associated physical memory. The node may alternatively correspond to a processor with shared memory and/or resources. Further, software instructions to perform embodiments of the invention may be stored on a tangible, non-transitory computer-readable medium such as a digital video disc (DVD), compact disc (CD), a diskette, a tape, or any other suitable computer-readable storage device.

One or more embodiments of the present invention may have one or more of the following advantages.

One or more embodiments provide for a pressure limiting controller that is stable across an entire spectrum of operating conditions and blockages of a mud pump system. This stability is particularly important when a mud pressure surge occurs due to a drill bit blockage. Indeed, because the pressure limiting controller is configured to generate adaptive gains that are proportional to the level of blockage, the resulting pressure limiting factor output may quickly reduce the motor speed of the mud pump system in order to restore the mud pressure to a safe operating level.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A mud pump system comprising:

a pump adapted to pump a pressurized flow of mud through a drillstring in a borehole;

pressure sensors disposed in contact with the pressurized flow for detecting a pressure of the pressurized flow;

a pressure limiting controller configured to control a motor speed of the pump in response to the pressure detected by the pressure sensors, wherein the pressure limiting controller generates a pressure limiting factor output using a pressure feedback input and a motor speed input to calculate a fluid conductance estimate, wherein the pressure limiting controller maintains the pressure limiting factor output at a maximum value based on a pressure set-point, wherein the pressure limiting controller continuously updates a normal fluid conductance value based on the fluid conductance estimate while the pressure limiting factor output remains at the maximum value, wherein the pressure limiting controller freezes the normal fluid conductance value, if the pressure limiting factor output is less than the maximum value, wherein the pressure limiting controller calculates a change in fluid conductance based on the normal fluid conductance value and the fluid conductance estimate, wherein the pressure limiting controller generates at least one adaptive gain based on the change in fluid conductance, and wherein the pressure limiting controller controls a motor speed of the pump based on the at least one adaptive gain.

2. The mud pump system of claim 1, wherein the pressure limiting factor output is generated using the pressure set-point, the at least one adaptive gain, and at least one error.

3. The mud pump system of claim 1, wherein the pressure limiting factor output is normalized between zero and one.

4. The mud pump system of claim 1, wherein the maximum value is one.

5. The mud pump system of claim 1 further comprising: a multiplier configured to multiply the pressure limiting factor output by a speed set-point to generate a speed output.

6. The mud pump system of claim 1, wherein the at least one adaptive gain is at least one selected from the group consisting of proportional gain, integral gain, and derivative gain.

7. The mud pump system of claim 1, wherein the at least one error is at least one selected from the group consisting of error in pressure, integral of error, and derivative of error.

8. The mud pump system of claim 2, further comprising:

a multiplier configured to multiply the pressure limiting factor output by a speed set-point to generate a speed output, wherein the pressure limiting factor output is normalized between zero and one, wherein the maximum value is one, wherein the at least one adaptive gain is at least one selected from the group consisting of proportional gain, integral gain, and derivative gain, and wherein the at least one error is at least one selected from the group consisting of error in pressure, integral of error, and derivative of error.

9. A method of controlling pressure in a mud pump system, the method comprising:

generating a pressure limiting factor output using a pressure feedback input and a motor speed input to calculate a fluid conductance estimate, maintaining the pressure limiting factor output at a maximum value based on a pressure set-point, continuously updating a normal fluid conductance value based on the fluid conductance estimate while the pressure limiting factor output remains at the maximum value, freezing the normal fluid conductance value, if the pressure limiting factor output is less than the maximum value, calculating a change in fluid conductance based on the normal fluid conductance value and the fluid conductance estimate, generating at least one adaptive gain based on the change in fluid conductance, and controlling a motor speed of a pump in the mud pump system based on the at least one adaptive gain.

10. The method of claim 9, wherein the pressure limiting factor output is generated based on the pressure set-point, the at least one adaptive gain, and at least one error.

11. The method of claim 9, wherein the pressure limiting factor output is normalized between zero and one.

12. The method of claim 9, wherein the maximum value is one.

13. The method of claim 9, further comprising multiplying the pressure limiting factor output by a motor set-point to generate a speed output.

14. The method of claim 9, wherein the at least one adaptive gain is at least one selected from the group consisting of proportional gain, integral gain, and derivative gain.

15. The method of claim 9, wherein the at least one error is at least one selected from the group consisting of error in pressure, integral of error, and derivative of error.

16. The method of claim 10 further comprising:

multiplying the pressure limiting factor output by a motor set-point to generate a speed output, wherein the pressure limiting factor output is generated based on the pressure set-point, the at least one adaptive gain, and at least one error, wherein the pressure limiting factor output is normalized between zero and one, wherein the maximum value is one, wherein the at least one adaptive gain is at least one selected from the group consisting of proportional gain, integral gain, and derivative gain, and wherein the at least one error is at least one selected from the group consisting of error in pressure, integral of error, and derivative of error.

17. A computer-readable medium storing a program for causing a computer to perform a method comprising:

generating a pressure limiting factor output using a pressure feedback input and a motor speed input to calculate a fluid conductance estimate, maintaining the pressure limiting factor output at a maximum value based on a pressure set-point, continuously updating a normal fluid conductance value based on the fluid conductance estimate while the pressure limiting factor output remains at the maximum value, freezing the normal fluid conductance value, if the pressure limiting factor output is less than the maximum value, calculating a change in fluid conductance based on the normal fluid conductance value and the fluid conductance estimate, generating at least one adaptive gain based on the change in fluid conductance, and controlling a motor speed of a pump in the mud pump system based on the at least one adaptive gain.

18. The computer-readable medium of claim 17 storing a program for causing a computer to perform a method further comprising:

multiplying the pressure limiting factor output by a motor set-point to generate a speed output, wherein the pressure limiting factor output is generated based on the pressure set-point, the at least one adaptive gain, and at least one error, wherein the pressure limiting factor output is normalized between zero and one, wherein the maximum value is one, wherein the at least one adaptive gain is at least one selected from the group consisting of proportional gain, integral gain, and derivative gain, and wherein the at least one error is at least one selected from the group consisting of error in pressure, integral of error, and derivative of error.

* * * * *